US005714118A

United States Patent [19]

Scheurman, III

[11] Patent Number: 5,714,118

[45] Date of Patent: Feb. 3, 1998

[54] METHOD AND COMPOSITION FOR INHIBITING CORROSION

[75] Inventor: Clarence Scheurman, III, Westlake, Ohio

[73] Assignee: Applied Specialties, Inc., Avon Lake, Ohio

[21] Appl. No.: 747,445

[22] Filed: Nov. 12, 1996

Related U.S. Application Data

[62] Division of Ser. No. 291,589, Aug. 15, 1994, Pat. No. 5,589,107.

[51] Int. Cl.[6] ..... C23F 11/14; C23F 15/00; C23C 22/00

[52] U.S. Cl. ..... 422/13; 422/16; 252/390; 252/392; 252/188.28; 252/389.61; 252/389.62; 210/750; 106/14.37

[58] Field of Search ..... 422/13, 16; 252/392, 252/390, 389.62, 389.61, 188.28; 210/750; 106/14.37

[56] References Cited

U.S. PATENT DOCUMENTS

| | | | |
|---|---|---|---|
| 4,067,690 | 1/1978 | Cuisia et al. | 422/16 |
| 4,079,018 | 3/1978 | Noack | 252/389.53 |
| 4,124,500 | 11/1978 | Arghiropoulos et al. | 210/757 |
| 4,269,717 | 5/1981 | Slovinsky | 210/750 |
| 4,350,606 | 9/1982 | Cuisia et al. | 252/392 |
| 4,469,761 | 9/1984 | Lange, Jr. | 429/50 |
| 4,487,708 | 12/1984 | Muccitelli | 252/178 |
| 4,569,783 | 2/1986 | Muccitelli | 252/188.28 |
| 4,626,411 | 12/1986 | Nemes et al. | 422/13 |
| 4,627,921 | 12/1986 | Meyers et al. | 210/669 |
| 4,681,737 | 7/1987 | Walker et al. | 422/16 |
| 4,689,201 | 8/1987 | Longworth et al. | 422/16 |
| 4,886,090 | 12/1989 | Hays | 137/607 |
| 4,891,141 | 1/1990 | Christensen et al. | 210/750 |
| 4,968,438 | 11/1990 | Soderquist et al. | 210/750 |
| 4,980,128 | 12/1990 | Cuisia et al. | 422/16 |
| 5,091,108 | 2/1992 | Harder et al. | 252/188.28 |
| 5,094,814 | 3/1992 | Soderquist et al. | 422/16 |
| 5,164,110 | 11/1992 | Haraer et al. | 252/188.28 |
| 5,167,835 | 12/1992 | Harder | 210/750 |
| 5,213,678 | 5/1993 | Rondum et al. | 208/48 AA |
| 5,256,311 | 10/1993 | Rossi et al. | 210/750 |
| 5,258,125 | 11/1993 | Kelley et al. | 210/750 |
| 5,271,847 | 12/1993 | Chen et al. | 210/697 |

*Primary Examiner*—Hien Tran

*Attorney, Agent, or Firm*—Pearne, Gordon, McCoy & Granger LLP

[57] ABSTRACT

Corrosion of ferrous metal surfaces in an aqueous system, such as a boiler system, is inhibited by adding a first component and a second component, the first component being preferably carbohydrazide, hydrazine, or a salt thereof, the second component being selected from the group consisting of certain hydroxylamine compounds or mixtures thereof, preferably N,N-diethylhydroxylamine. The weight ratio of the added first component to the added second component is between about 4:1 and about 1:4.

23 Claims, No Drawings

METHOD AND COMPOSITION FOR INHIBITING CORROSION

This is a division of application Ser. No. 08/291,589, filed Aug. 15, 1994 now U.S. Pat. No. 8,589,107.

BACKGROUND OF THE INVENTION

This invention relates generally to inhibition and control of corrosion of metal surfaces in an aqueous system and more specifically to compositions and methods to passivate iron and steel surfaces in boiler and cooling systems.

DESCRIPTION OF RELATED ART

In boilers, closed loop cooling systems, heat exchangers, and other aqueous systems, corrosion of metal surfaces is a severe problem. In boiler systems, corrosion may occur in feed lines, the boiler, steam lines, steam condensate return lines, heaters, economizers, and other parts of the boiler system. Similar corrosion may occur in closed loop cooling systems. Corrosion generally arises from dissolved oxygen and other chemicals attacking the iron or steel surfaces, which attack is accelerated by the high temperatures found in boiler systems. Since acidic conditions tend to accelerate this type of corrosion, most boiler and cooling systems are operated under alkaline conditions.

Typically in boiler systems three things are done to protect ferrous metal from corrosion. Most of the dissolved oxygen and other gases are first mechanically removed by vacuum degasifiers or deaerating heaters. Secondly, chemicals are added to chemically scavenge remaining oxygen. Thirdly, the same or different chemicals are added to passivate the metal surfaces, that is, protect them from attack by oxygen or other chemicals. Similar approaches are used with cooling systems.

Hydrazine has been used for many years as a boiler water treatment. It can react with residual dissolved oxygen to form water and gaseous nitrogen. Under certain conditions it can act as a metal passivator by forming a protective layer of magnetite over iron surfaces. However, hydrazine is a toxic chemical and industry is attempting to minimize its use.

Other boiler and cooling water treatments have been suggested. See, for example, U.S. Pat. Nos. 5,258,125; 4,689,201; 4,626,411; 4,350,606; 4,269,717; and 4,067,690, the contents of which are incorporated by reference in their entirety. However, most of these treatments focus too much on oxygen removal and not enough on metal surface passivation. What is needed is a treatment which passivates and covers and coats the metal surfaces to such an extent that any dissolved oxygen which is present is unable to effectively attack the surface. When the metal surface is sufficiently passivated, certain levels of dissolved oxygen can be tolerated. It is an object of the present invention to provide effective metal surface passivation, particularly in high pressure, high temperature boiler systems.

SUMMARY OF THE INVENTION

A method for inhibiting corrosion of ferrous metal surfaces in an aqueous system is provided. The aqueous system contains system water having an alkaline pH, the method comprising adding to the system water a first component and a second component. The first component is selected from the group consisting of carbohydrazide, water-soluble salts of carbohydrazide, hydrazine, water-soluble salts of hydrazine, and mixtures of any of the foregoing. The second component is selected from the group consisting of certain hydroxylamine compounds or mixtures thereof, more particularly described hereinafter. The weight ratio of the added first component to the added second component is between about 4:1 and about 1:4. The total dosage of the first component and the second component to the system water together is an effective ferrous metal surface passivating amount. A composition comprising the first component and the second component is also provided.

DETAILED DESCRIPTION OF THE PREFERRED EMBODIMENTS

Parts per million (ppm) and parts per billion (ppb) as used herein are parts by weight.

The present invention is useful as a treatment or additive to inhibit and control corrosion of metal surfaces, such as ferrous metal surfaces, in an aqueous system such as a cooling system (particularly a closed loop cooling system) or a boiler system. An aqueous system contains system water; for example a cooling system contains cooling water and a boiler system contains boiler water. The system water, in the form of water or steam, typically and generally contacts the ferrous metal surface of the aqueous system, for example, the inner surfaces of metal pipes, tubes, tanks, etc.

The present invention includes adding a first component and a second component to system water to passivate ferrous metal surfaces in an aqueous system and to control and inhibit corrosion. The first component is selected from the group consisting of carbohydrazide, water-soluble salts of carbohydrazide, hydrazine, water-soluble salts of hydrazine, and mixtures of any of the foregoing and is preferably carbohydrazide due to the toxic nature of hydrazine and the performance results shown by carbohydrazide. Water-soluble salts are less preferred due to the presence of ionic material.

The second component is selected from the group consisting of certain hydroxylamine compounds or mixtures thereof, said certain hydroxylamine compounds having the general formula

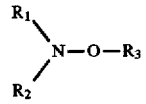

where $R_1$, $R_2$, and $R_3$ are either the same or different and are selected from the group consisting of hydrogen and lower alkyl containing 1 to about 6 (more preferably 1 to 3) carbon atoms, or a water-soluble salt thereof. Typical water-soluble salts are the phosphate, sulfate, and chloride salts, although there are others known in the art. Preferably the second component is used without these salts, in order to minimize ionic material in the system water. Preferably $R_3$ is hydrogen. The second component is preferably hydroxylamine, N,N-diethylhydroxylamine (DEHA), N,N-methylethylhydroxylamine, N,N-dimethylhydroxylamine, or N,N-methylpropylhydroxylamine, most preferably DEHA, although the second component can also be O-methyl-N,N-diethylhydroxylamine, O-methylhydroxylamine, N-ethylhydroxylamine, O-ethyl-N,N-dimethylhydroxylamine, and the other components and their salts described above.

Total organic carbon (TOC) is a concern in boiler systems powering a turbine, particularly a utility power station generating electricity with steam, where carbon can detrimentally get on the turbine blades. Such power stations prefer TOC levels of 200, more preferably 100, ppb or less; for treatment of such power station boiler systems each of the R groups of the second component preferably contains not more than 3 carbon atoms to keep TOC levels lower. In closed loop cooling systems and boiler systems (for example 1000 psi boilers) which do not operate a turbine, there typically is not a concern with high TOC levels, and these systems can generally tolerate dosages without regard to TOC levels.

The present invention requires the addition of the first and second components within certain effective weight ratios; the weight ratio of the added first component to the added second component should be a weight ratio effective to passivate, or enable passivation of, a ferrous metal surface, said weight ratio preferably being between 4:1 and about 1:4, more preferably between about 3:1 and about 1:3, even more preferably between about 2:1 and about 1:2. Preferably, the first component is carbohydrazide and the second component is DEHA and the weight ratio of the added carbohydrazide to the added DEHA is preferably between 4:1 and about 1:4, more preferably between about 3:1 and about 1:3, even more preferably between about 2:1 and about 1:2, and in some cases is preferably about 1:1. It is believed that the surprising passivating qualities of the present invention are related, at least in part, to the weight ratios of the first and second components.

The total dosage to the system water of the first component and the second component together should be an effective ferrous metal surface passivating amount; that is, an amount effective to passivate the ferrous metal surface; this amount is preferably between about i and about 10,000 parts per billion parts system water, more preferably between about 1 and about 1000 (more preferably about 500, more preferably about 100) parts per billion parts system water, more preferably between about 3 and about 40 parts per billion parts system water, even more preferably between about 5 and about 18 parts per billion parts system water. Also, this amount is preferably at least about one, more preferably at least about 3, and even more preferably at least about 5 parts per billion parts system water, and preferably not more than about 10,000, more preferably not more than about 1000, more preferably not more than about 500, more preferably not more than about 100, even more preferably not more than about 40, and even more preferably not more than about 18 parts per billion parts system water. Particularly with regard to boiler systems powering a turbine, dosages in excess of a minimum effective dosage should preferably be minimized or avoided to avoid TOC problems; TOC constraints will generally limit boiler systems powering a turbine to an effective ferrous metal surface passivating amount of about 100 parts or less per billion parts boiler water. When carbohydrazide is the first component, it is preferably added at an effective dosage, preferably between about 1 and about 25, more preferably between about 2 and about 10, parts per billion parts system water. Carbohydrazide is preferably added at a dosage effective to permit hydrazine detection equipment in the boiler or aqueous system to effectively monitor and/or control the composition being added. When DEHA is the second component, it is preferably added at an effective dosage, preferably between about 1 and about 25, more preferably between about 2 and about 10, parts per billion parts system water. Since DEHA has 4 carbon atoms and carbohydrazide has one, the preferred composition is preferably added at a dosage which will not cause a preselected TOC level, such as 100 or 200 ppb, measured preferably at the economizer inlet or the saturated steam location, to be exceeded.

Preferably the first and second components are premixed in an aqueous solution to form an additive or treatment and the additive is added or dosed to the system water. The first and second components together preferably form from about 1 to 50, more preferably from about 4 to about 10, weight percent of the additive.

The system water of the present invention is preferably alkaline; the boiler water preferably having a pH between about 8.5 and about 10.5 and the cooling water preferably having a pH between about 7 and about 12. Typically in boiler systems, ammonia is added to maintain alkalinity or pH in the condensate. One surprising and unexpected result of the present invention is that a lower ammonia feedrate is required to maintain requisite pH in a boiler system. As is known in the art (and which is unpreferred in the process of the present invention) some boiler systems may also add phosphate to keep the metal surfaces clean.

The present invention has particular utility and usefulness in high pressure, high temperature boiler systems (including sub to super critical) having or reaching an operating pressure of preferably at least 600 psi, more preferably at least 950 psi (and having a dissolved oxygen level generally throughout the system of about 20 ppb or less, more preferably about 10 ppb or less), because, among other reasons, sulfite treatments lose some or all utility at these conditions due to the temperatures associated with these pressures and the thermal decomposition of sulfite. (As is known in the boiler art, there is a relationship between operating pressure and temperature; 600 psi typically having a temperature around 490° F.; 950 psi around 540° F.). Some systems of this type get up to 3200 psi and temperatures around 1000° F. In a preferred embodiment, the present invention is used in boiler systems which reach temperatures of 298° F. and higher (pressures of about 50 psi and higher), as it is believed that carbohydrazide is decomposed to hydrazine at these temperatures. A boiler system treated with the present invention preferably has a deaerating heater, which preferably reduces the oxygen concentration to about 5–10 ppb, more preferably 6–9 ppb.

In a boiler system, particularly a high pressure utility boiler, the composition of the present invention is preferably added or dosed to the boiler water in the demineralized boiler water makeup line or shortly or immediately after the condensate pump (condensate pump discharge location), although it may less preferably be added at other points in the system, such as shortly after the deaerating heater (storage side of deaerating heater), or it may be added at multiple locations, such as both of the above locations during an outage, although it may be added after the condensate polisher for those systems which continuously run a condensate polisher. The advantages of dosing into the demineralized boiler water makeup line include 1) lower pressure, requiring a smaller pump, 2) more of the system is more effectively treated and passivated, 3) overall iron levels are reduced, and 4) there is more time for the treatment to react before sampling is done. The composition is preferably dosed to a closed loop cooling system at the low pressure side, although other locations can be used.

The present invention has particular utility in industrial and utility boilers operating at a pressure of at least 600 psi, particularly utility power stations such as fossil fueled and nuclear power stations. As is known in the art, such systems are essentially once-through systems, due to the presence of condensate polishers, deaerating heaters, and other equipment such as filters and vacuum degasifiers. In such boilers, the present invention is superior to other presently-available formulations in that it does not need to be fed based on dissolved oxygen content. It is fed based on iron levels. Iron levels are preferably measured at the economizer outlet, less preferably at the economizer inlet, even less preferably at the boiler, less preferably still at the feedwater pump after the deaerator, generally anywhere between the deaerator and the boiler. Preferably, total iron, both ferrous and ferric, suspended and dissolved, is measured. As used herein, including in the claims, "iron level" refers to ferrous iron, ferric iron, suspended iron, dissolved iron, or any combination thereof. When the boiler is started up, the present composition is dosed at an effective rate, such as 15 ppb of the first and second components together, and the total iron level is monitored until it gets down to a non-detectable level (depending on type of analytical equipment, about 1–2 ppb, less preferably 5 ppb or a higher level) or another preselected level, such as 10 ppb or 100 ppb. The dosage rate is then reduced to a rate, such as 7.5 ppb, to maintain total iron at or near said non-detectable or other preselected level. This reduced rate is unexpectedly low compared to other commercial treatments.

The present invention is particularly useful in that it passivates the ferrous metal surfaces in the colder or low temperature sections of high pressure boilers, as well as the other sections, including high temperature sections, and is reactive and effective at relatively low temperatures (40°–298° F.). It may also be fed to mid and low temperature condensate lines to stop corrosion in these lines thereby reducing both iron fouling and iron loading on downstream equipment. It is useful in passivating new or recently cleaned boiler or closed loop systems, and in passivating closed loop cooling systems, which generally operate at 40°–185° F., particularly closed loop cooling systems which require low conductivity (preferably 50 micromhos or less) and high quality water.

In utility and industrial boilers it is preferable to keep cation conductivity (generally measured on both sides of the condensate polisher) low to minimize deposits, such as deposits on the steel. Cations are frequently removed by condensate polishers. Hydroxylamines can break down to cations at high temperatures; it is preferable to dose the present invention at levels which do not detrimentally maintain or materially or significantly increase cation levels; particularly for high pressure utility boilers, the invented composition is preferably dosed so that cation conductivity is maintained at 0.2 micromhos or less, measured before the condensate polisher.

The composition and method of the invention are further explained and illustrated with the following examples.

EXAMPLE 1

An experiment was conducted at a commercial utility power station having two identical high pressure, high temperature boiler systems (Unit 1 and Unit 2), each operating with alkaline water at a pressure of approx. 2650 psi and a temperature of about 1000° F. Both Units had customary equipment, including economizers, air preheaters, deaerating heaters, vacuum pumps, condensate polishers to remove ionic material, and makeup water demineralizers. For a period of about five months, Unit 1 was treated at a rate of about 3 gallons/day with an available commercial formulation believed to contain 6–7 weight percent carbohydrazide and about 0.5 weight percent hydroquinone in water. For the same period of time Unit 2 was treated at the same rate with compositions of the present invention; beginning with a composition which was 5 weight percent carbohydrazide and 2.5 weight percent DEHA, and then modifying that to a composition which was 3.75 weight percent carbohydrazide and 3.75 weight percent DEHA. During the test period the levels of oxygen, hydrazine, and iron in Unit 2 were surprisingly more stable than the corresponding levels in Unit 1, that is, they did not fluctuate as much. After the test periods Units i and 2 were inspected and it was observed that the colder sections (from the condensate pump through the economizer section up to the boiler inlet) of Unit 2 were protected and passivated and in clearly better condition than the colder sections of Unit 1, particularly the section from the condensate pump through the deaerating heater. The water temperature is generally about 90°–140° F. at and immediately after the condensate pump, rising to about 300°–360° F. at the storage side of the deaerating heater, rising to about 500°–700° F. at the boiler inlet.

EXAMPLE 2

An experiment was conducted at a commercial utility power station having two identical high pressure, high temperature boiler systems (Unit A and Unit B), each operating with alkaline water at a pressure of approximately 2650 psi and a temperature of about 1000° F. Both Units had the customary equipment identified in Example 1 and used demineralized makeup water. For a period of about five months, Unit A was treated at a rate of about 3 gallons/day with an available commercial formulation believed to contain 35 weight percent hydrazine in water. For the same period of time Unit B was treated at a staged rate or feedrate initially of about 3, then about 1.5, then about 1, gallons/day with compositions of the present invention, being carbohydrazide and DEHA in water, the weight percents of carbohydrazide and DEHA, respectively, being initially 5 and 2.5, then being modified to 3.75 and 3.75, and ending with 3.5 and 4. After the test periods Units A and B were inspected and it was observed that the colder sections (as described in Example 1) of Unit B were protected and passivated and in clearly better condition than the colder sections of Unit A, particularly the section from the condensate pump through the deaerating heater. The passivated metal surface of Unit B had an adherent black magnetite-type passivating coating which was better, more uniform and consistent, and much stronger than the corresponding coating on Unit A. In addition, the passivating coating of Unit B did not suffer surface oxidation when exposed to atmospheric air but remained black, while the corresponding coating of Unit A suffered surface oxidation, turning red when exposed to atmospheric air. As a result of the superior passivation of Unit B and its not suffering surface oxidation, Unit B was able to be brought back on line much more quickly than Unit A, and with greatly reduced cost and better water/steam quality. It was also unexpectedly observed that the condensate receiver tank of the condenser itself on Unit B experienced superior ferrous metal passivation.

It was surprising and unexpected that the present invention would provide ferrous metal surface passivation significantly superior to that of two other commercially used boiler water treatments used at commercial dosage rates, and that reduced feedrates of the present invention could be used with excellent control still being maintained. It was also surprising and unexpected that the oxygen, hydrazine, and iron levels tended to be more stable when the boiler water was treated with the present invention. An advantage of the invented treatment program compared to other programs is that the invented program is generally less affected by periodically high dissolved oxygen levels, such as caused by an air leak. Since the present invention provides superior ferrous metal passivation the boiler system can tolerate higher dissolved oxygen levels, since oxygen which is present is not able to as successfully attack the ferrous metal.

Although particular embodiments of the invention have been described in detail, it will be understood that the invention is not limited correspondingly in scope, but includes all changes and modifications coming within the spirit and terms of the claims appended hereto.

What is claimed is:

1. A method for inhibiting corrosion of ferrous metal surfaces in an aqueous system, said aqueous system containing system water having an alkaline pH, said method comprising adding to said system water a first component and a second component, said first component being selected from the group consisting of carbohydrazide, water-soluble salts of carbohydrazide, hydrazine, water-soluble salts of hydrazine, and mixtures of any of the foregoing, said second component being selected from the group consisting of certain hydroxylamine compounds or mixtures thereof, said certain hydroxylamine compounds having the formula

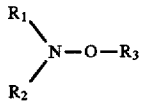

where $R_1$, $R_2$, and $R_3$ are either the same or different and are selected from the group consisting of hydrogen and lower alkyl containing 1 to about 6 carbon atoms, or a water-soluble salt thereof; the weight ratio of the added first component to the added second component being between about 4:1 and about 1:4; and the total dosage of the first component and the second component to the system water together being an effective ferrous metal surface passivating amount.

2. The method of claim 1, wherein said effective ferrous metal surface passivating amount is between about 1 and about 10,000 parts per billion parts system water.

3. The method of claim 2, wherein said effective ferrous metal surface passivating amount is between about 1 and about 100 parts per billion parts system water.

4. The method of claim 1, wherein said system water is in a boiler system being operated at a pressure of at least 600 psi.

5. The method of claim 1, wherein said first component is carbohydrazide.

6. The method of claim 1, wherein said second component is N,N-diethylhydroxylamine.

7. The method of claim 5, wherein said second component is N,N-diethylhydroxylamine.

8. The method of claim 4, wherein said boiler system comprises a demineralized boiler water makeup line, said first and second components being added into said demineralized boiler water makeup line.

9. The method of claim 4, wherein said boiler system comprises a condensate pump, said condensate pump defining a condensate pump discharge location, said first and second components being added at said condensate pump discharge location.

10. The method of claim 1, further comprising the step of monitoring an iron level in the system water and changing the total dosage of the first and second components together in response to a change in said iron level.

11. The method of claim 4, said boiler system having an economizer inlet, wherein said first and second components are added at a rate such that the total organic carbon level of the boiler system, measured at the economizer inlet, does not exceed 200 ppb.

12. The method of claim 4, wherein the first component is carbohydrazide, the second component is N,N-diethylhydroxylamine, and the weight ratio of the first component to the second component is between about 2:1 and about 1:2.

13. The method of claim 1, wherein said effective ferrous metal surface passivating amount is at least about one part per billion parts system water.

14. A method according to claim 1, wherein the weight ratio of the first component to the second component is between about 2:1 and about 1:2.

15. A method according to claim 7, wherein the weight ratio of the first component to the second component is between about 2:1 and about 1:2.

16. A method according to claim 4, wherein said system water is in a boiler system being operated at a pressure of at least 950 psi.

17. A method according to claim 4, wherein said boiler system comprises a condensate polisher, said first component and said second component being added at a dosage so that cation conductivity is maintained at 0.2 micromhos or less, measured before said condensate polisher.

18. A method for inhibiting corrosion of ferrous metal surfaces in an aqueous system, said aqueous system containing system water having an alkaline pH, said method consisting essentially of adding to said system water a first component and a second component, said first component being selected from the group consisting of carbohydrazide, water-soluble salts of carbohydrazide, hydrazine, water-soluble salts of hydrazine, and mixtures of any of the foregoing, said second component being selected from the group consisting of certain hydroxylamine compounds or mixtures thereof, said certain hydroxylamine compounds having the formula

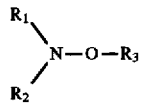

where $R_1$, $R_2$, and $R_3$ are either the same or different and are selected from the group consisting of hydrogen and lower alkyl containing 1 to about 6 carbon atoms, or a water-soluble salt thereof; the weight ratio of the added first component to the added second component being between about 4:1 and about 1:4; and the total dosage of the first component and the second component to the system water together being an effective ferrous metal surface passivating amount, said method being effective for passivating said ferrous metal surfaces.

19. A method according to claim 18, wherein said first component is carbohydrazide.

20. A method according to claim 18, wherein said second component is N,N-diethylhydroxylamine.

21. A method according to claim 19, wherein said second component is N,N-diethylhydroxylamine.

22. A method according to claim 18, wherein the weight ratio of the first component to the second component is between about 2:1 and about 1:2.

23. A method according to claim 21, wherein the weight ratio of the first component to the second component is between about 2:1 and about 1:2.

* * * * *